US007669632B2

(12) United States Patent
Moriya et al.

(10) Patent No.: US 7,669,632 B2
(45) Date of Patent: Mar. 2, 2010

(54) SLIDING SCREEN DOOR

(75) Inventors: Takashi Moriya, Suginami-ku (JP); Hirofumi Moriya, Suginami-ku (JP)

(73) Assignee: Seiki Sogyo Co., Ltd., Tokyo (JP)

( * ) Notice: Subject to any disclaimer, the term of this patent is extended or adjusted under 35 U.S.C. 154(b) by 0 days.

(21) Appl. No.: 11/576,840

(22) PCT Filed: Oct. 7, 2004

(86) PCT No.: PCT/JP2004/014859

§ 371 (c)(1),
(2), (4) Date: Apr. 6, 2007

(87) PCT Pub. No.: WO2006/038302

PCT Pub. Date: Apr. 13, 2006

(65) Prior Publication Data

US 2008/0092454 A1 Apr. 24, 2008

(51) Int. Cl.
*A47H 1/00* (2006.01)
*A47H 5/00* (2006.01)
*E05D 15/06* (2006.01)

(52) U.S. Cl. ..... 160/31; 160/84.06; 160/194

(58) Field of Classification Search ..... 160/194, 160/201, 240, 242, 243, 245, 264, 268, 271, 160/272, 277, 279, 31, 84.04, 84.05, 84.06
See application file for complete search history.

(56) References Cited

U.S. PATENT DOCUMENTS 5,377,737 A * 1/1995 Moriya et al. ..... 160/84.06
6,408,922 B2 * 6/2002 Desrochers ..... 160/24
6,814,127 B2 * 11/2004 Tagtow et al. ..... 160/31
2001/0042346 A1 * 11/2001 Brioschi ..... 49/447

FOREIGN PATENT DOCUMENTS

| | | | |
|---|---|---|---|
| JP | 6 158961 | | 6/1994 |
| JP | 3143021 | | 3/2001 |
| JP | 2003161089 | * | 6/2003 |
| JP | 2003 201796 | | 7/2003 |
| JP | 2004 3204 | | 1/2004 |
| JP | 2004 346578 | | 12/2004 |

* cited by examiner

*Primary Examiner*—Katherine W Mitchell
*Assistant Examiner*—Jeremy C Ramsey
(74) *Attorney, Agent, or Firm*—Oblon, Spivak, McClelland, Maier & Neustadt, L.L.P.

(57) ABSTRACT

A lateral pull wire screen with a net attached, between a first longitudinal frame member in a wire screen frame and a movable frame for an opening/closing operation, to be openable/closable by a lateral pull; a net guide guiding the lower end of the net goes in and out in compliance with the opening/closing of the net. The left/right convenience in the net opening/closing can be altered by the first longitudinal frame member and the movable frame, together with the net attached between them, having substantially upside/downside symmetrical shapes, and reversing them in their upsides/downsides without reversing their fronts and backs. Also, the net guide can be altered in its attachment position by, upon the upside/downside reversions, selectively attaching the net guide to attachment parts provided in both ends of the first longitudinal frame member fixing one end of the net guide.

11 Claims, 8 Drawing Sheets

SLIDING SCREEN DOOR

TECHNICAL FIELD

The present invention is relating to a wire screen in which a net is made openable/closable by a lateral pull and, more concretely, is relating to a lateral pull wire screen having a net guide introduced out along a lower end of the net in compliance with an opening/closing of the net.

BACKGROUND ART

The lateral pull wire screen in which the net is made openable/closable by the lateral pull, and which has the flexible net guide introduced out along the lower end of the ret in compliance with the opening/closing of the net, is hitherto publicly known as disclosed in Patent Document 1 for instance.

Further, a wire screen which has a wire screen frame fixed to a building opening part, a net attached in the wire screen frame so as to be openable/closable by the lateral pull, and a winding box accommodating the net, and in which a longitudinal frame member of the wire screen frame is constituted by the winding box, is hitherto publicly known as disclosed in Patent Document 2 for instance.

Additionally, in a case where a left/right convenience of the lateral pull wire screen is altered while being coincided with a door of the building opening part, or the like, from olden times there is known the fact that the wire screen is reversed in its upside and downside with its front and back being kept intact, or that the wire screen is reversed in its front and back with its upside and downside being kept intact.

In the lateral pull wire screen having the net guide, which is disclosed in the Patent Document 1, since the net guide guiding a lower end of the net under its stretched state goes in and out to and from an inside of a movable frame from its lower end, there is a convenience in a point that underfoot there is no thing becoming a hindrance of walking when going in and out to and from the building opening part. However, when selecting or altering the left/right convenience while being coincided with the door of the building opening part, since structures of an upper part and a lower part of the wire screen differ, it is impossible to alter the left/right convenience by reversing the wire screen in its upside and downside and, therefore, it is necessary to alter the left/right convenience by reversing the wire screen in its front and back.

Further, since the lateral pull wire screen disclosed in the Patent Document 1 is a wire screen in which a stretchable net alternately folded back in reverse directions is made openable/closable by the lateral pull, it is also possible to alter the left/right convenience by making the longitudinal frame member or the movable frame, which constitutes the wire screen frame, into a front/back symmetrical shape in an external appearance, and reversing the wire screen in its front and back without reversing its upside and downside. However, since each part is made into the front/back symmetrical shape in the external appearance, there is also the fact that a useless cost must be spent because there is a necessity to apply a makeup to its front-back both faces and, further, there is also the fact that a compatibility between it and an attachment structure for attaching the wire screen to the building opening part is difficult.

On the other hand, since the lateral pull wire screen disclosed in the Patent Document 2 is a lateral pull wire screen of a type in which the net is wound around a winding shaft accommodated in the winding box and it is difficult to make the winding box into the front/back symmetrical shape in the external appearance, there has been an issue that the left/right convenience cannot be altered by reversing the wire screen in its front and back. If the whole wire screen including the winding box and the wire screen frame is forcedly made into the front/back symmetrical shape in the external appearance, it is possible to alter the left/right convenience by reversing the whole wire screen in its front and back. However, in that case, it is necessary to make the whole of the wire screen frame into the same prospective dimension as the winding box, so that there has been an issue that the prospective dimension becomes large as a whole. Further, if the net guide guiding the lower end of the net is provided so as to go in and out to and from the inner part of the movable frame or the like from its lower end, since the structures of the upper part and the lower part of the wire screen differ, there has been an issue that it is also impossible to alter the left/right convenience by reversing the wire screen in its upside and downside Patent Document 1: JP-A-2003-201796 Gazette Patent Document 2: JP-A-2003-106076 Gazette

DISCLOSURE OF THE INVENTION

Problems that the Invention is to Solve

The invention is to solve such issues as mentioned above, and its technical problem is provide a lateral pull wire screen in which it is possible to alter the left/right convenience, notwithstanding the fact that it is the lateral pull wire screen having the net guide introduced out along the lower end of the net in compliance with the opening/closing of the net.

Further, the invention is to provide a lateral pull wire screen in which it is possible to alter the left/right convenience without enlarging the prospective dimension of the whole wire screen, notwithstanding the fact that it is the lateral pull wire screen having the winding box.

Means for Solving the Problems

In order to solve the above problems, the invention is a lateral pull wire screen in which a wire screen frame fixed to a building opening part has first and second longitudinal frame members disposed in mutually opposed positions, and a lateral frame member in an upper part, and in which between the first longitudinal frame member in the wire screen frame and a movable frame for an opening/closing operation there is attached a net so as to be openable/closable by a lateral pull, and which has a net guide made such that its one end is fixed to a lower end of one of the first longitudinal frame member and the movable frame, the other end goes in and out to and from an inside from a lower end of the other of the same while being bent in compliance with an opening/closing of the net by the lateral pull of the movable frame, and it guides a lower end of the net under a stretched state, characterized in that a left/right convenience in a net opening/closing can be altered by forming the first longitudinal frame member and the movable frame, together with the net attached between them, substantially upside/downside symmetrical shapes to be reversed in their upsides and downsides without reversing them in their fronts and backs, forming the second longitudinal frame member substantially an upside/downside symmetrical shape or a front/bank symmetrical shape, and forming the lateral frame member substantially a front/back symmetrical shaper or in a manner such that to its both ends the first and second longitudinal frame members can be selectively connected, and the net guide is made substantially a front/back symmetrical shape, and an attachment part selectively attaching the net guide is provided in both ends of the first longitudinal frame member fixing the one end of the net guide or the movable frame.

In a desirable implementation mode of the lateral pull wire screen of the invention, the first longitudinal frame member in the wire screen frame, the movable frame and the net attached between them are constituted as a wire screen main body capable of treating them monolithically, and, by making them substantially upside/downside symmetrical shapes and reversing their upsides and downsides without reversing their fronts and backs, it is made possible to alter the left/right convenience in the opening/closing of the net. On the other hand, the second longitudinal frame member, the lateral frame member and the net guide are made substantially front/back symmetrical shapes, and used with their fronts and backs being reversed in compliance with a necessity. And, by fixing one end of the net guide so as to be positioned in a lower end of the first longitudinal frame member, it becomes possible to simply alter the left/right convenience in the opening/closing of the lateral pull wire screen.

In other desirable implementation mode of the invention, one of the first longitudinal frame member and the movable frame is constituted as a winding box having possessed a winding shaft which winds the net by a biasing force of a spring, and further the movable frame has a movable frame main body of an upside/downside symmetrical shape, a frame cap in an upper part and a frame cap in a lower part, which can be selectively attached to both-end parts of the movable frame main body, and a lock mechanism attached to the movable frame main body so as to be capable of adjusting upside and downside positions, and engaging with the second longitudinal frame member, and the frame cap in the upper part possesses a guide mechanism guided by the lateral frame member, and the frame cap in the lower part is constituted as one possessing a bend guide causing the net guide to go in and out to and from the movable frame main body while being bent.

Additionally, in other desirable implementation mode of the invention, the net guide is constituted by connecting many guide pieces made of a synthetic resin, which is formed, in approximately like a U-letter, by bottom parts along a lower end of the net and standing wall parts which stand up along an outer face of the net. An attachment part in the guide piece of a base end side in the guide pieces under a connected state can be constituted as an engagement structure capable of detachably engaging with engagement parts provided in caps of an upper end part and a lower end part of the winding box.

Further, the lock mechanism has a lock part piece which is provided in the movable frame, slidable upward/downward in a lock cover and automatically engages with a lock receiver of the second longitudinal frame member when being butted against the second longitudinal frame member, and one pair of inside and outside operation knobs connected to the lock part piece, and the lock cover, the lock part piece and the operation knobs, which are provided in the movable frame, and the lock receiver provided in the second longitudinal frame member are constituted so as to be respectively adjustable for upside and downside positions, and to function with their upsides and downsides being reversed.

Incidentally, here, the fact that, about the frame member or the like, there is explained as substantially the upside/downside symmetrical shape or the front/back symmetrical shape does not mean the fact that it is precisely the symmetrical shape while including also an internal structure, but does mean a constitution which is symmetrical when seen in an external appearance or functionally, and can be used even under a reversed state.

In the lateral pull wire screen having the above constitution, since the wire screen main body which is constituted by the first longitudinal frame member in the wire screen frame, the movable frame and the net attached between them is substantially the upside/downside symmetrical shape and makes it possible to alter the left/right convenience in the opening/closing of the net by reversing them in their upsides and downsides without reversing them in their fronts and backs, it can be used by reversing the second longitudinal frame member, the lateral frame member and the net guide in their fronts and backs, as necessary. And, by fixing one end of the net guide so as to be positioned in a lower end of one end part of the first longitudinal frame member or the movable frame and causing it to go in and out to and from the inside from the other lower end of the same while being bent, the left/right convenience in the opening/closing of the lateral pull wire screen car be arbitrarily set or simply altered without applying a special working.

Further, since the frame caps in the upper part and the lower part can be selectively attached to the both-end parts of the movable frame main body and the lock mechanism is adjustable for the upside and downside positions, by suitably mounting these members, the lateral pull wire screen can be used without any hindrance even if its left/right convenience is altered.

Advantage of the Invention

According to the lateral pull wire screen of the invention, which has been detailedly mentioned above, notwithstanding the fact that it is the lateral pull wire screen having the net guide introduced out along the lower end of the net in compliance with the opening/closing of the net, it is possible to alter the left/right convenience and, further even if it is the lateral pull wire screen having the winding box, it is possible to alter the left/right convenience without enlarging the prospective dimension of the whole wire screen frame.

DESCRIPTION OF REFERENCE NUMERALS

1 wire screen frame

2 first longitudinal frame member

2*a* gap

Figure 1:
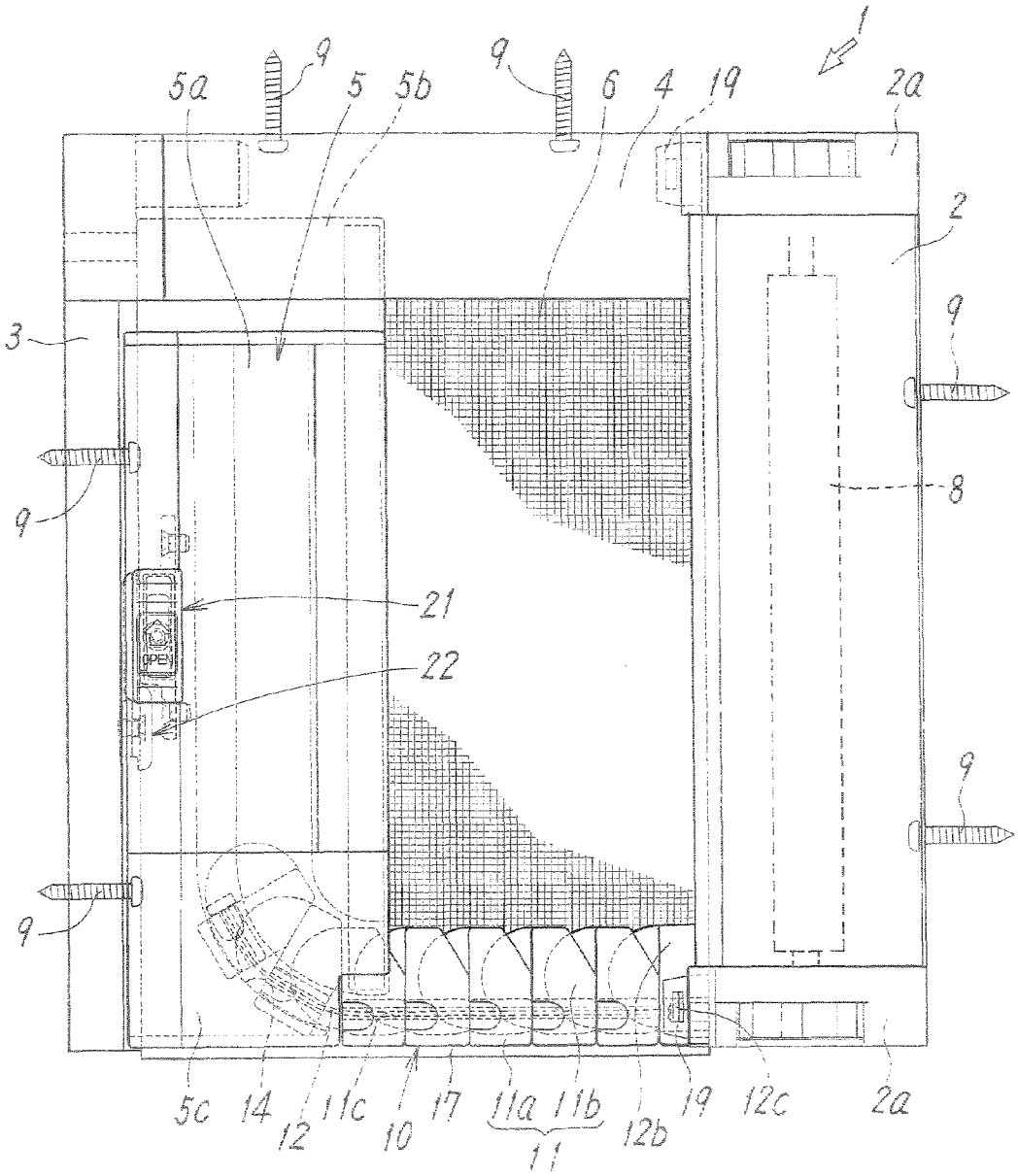
[FIG. 1] It is a front view showing one embodiment of a lateral pull wire screen concerned with the invention.

3 second longitudinal frame member
4 lateral frame member
5 movable frame
5*a* movable frame main body
5*b* upper part frame cap
5*c* lower part frame cap
6 net
8 winding shaft
10 net guide
11 guide piece
19 attachment part
21 lock mechanism
22 lock receiver
25 lock cover
26 lock part piece
27, 28 knob

BEST MODE FOR CARRYING OUT THE INVENTION

FIG. 1-FIG. 4 show one embodiment of a lateral pull wire screen concerned with the invention.

As shown in FIG. 1, this lateral pull wire screen possesses a wire screen frame 1 fixed to a building opening part. This wire screen frame 1 has a first longitudinal frame member 2 and a second longitudinal frame member 3, which are disposed in mutually opposed both-side positions of the building opening part, and a lateral frame member 4 in an upper part. Further, between the first longitudinal frame member 2 and the second longitudinal frame member 3, there is provided a movable frame 5 for an opening/closing operation, which moves left and right while being guided by the lateral frame member 4 in the upper part and, between the first longitudinal frame member 2 in the wire screen frame 1 and the movable frame 5, there is attached a net 6 which is openable/closable by the lateral pull. Additionally, there is possessed a flexible net guide 10 which goes in and out to and from an inside of the movable frame 5 from its lower end in compliance with an opening/closing of the net 6, thereby guiding a lower end of the net 6 under its stretched state.

In this embodiment, although the first longitudinal frame member 2 is constituted as a winding box accommodating a winding shaft 8 around which the flat net 6 is wound by a biasing force of a spring, it is also possible to accommodate the winding shaft in the movable frame 5 and constitute it as the winding box. Additionally, it is also possible to tension-provide, between the first longitudinal frame member and the movable frame 5, a net, which is made expandable like an accordion by being mutually folded back in reverse directions, so as to be openable/closable. Further in the above embodiment, although there is constituted such that one end of the net guide 10 is fixed to a lower end of the first longitudinal frame member 2 and the other end goes in and out to and from the inside of the movable frame 5 from its lower end, especially in a case where the above net like the accordion is used, it is also possible to constitute it such that one end of the net guide 10 is fixed to the lower end of the movable frame 5 and the other end goes in and out to and from the inside of the first longitudinal frame member 2 from its lower end.

On the other hand, the second longitudinal frame member 3 is constituted as a receiving frame which retains the movable frame 5 when the net 6 is tension-provided in the wire screen frame 1 by the movable frame 5.

Figure 2:
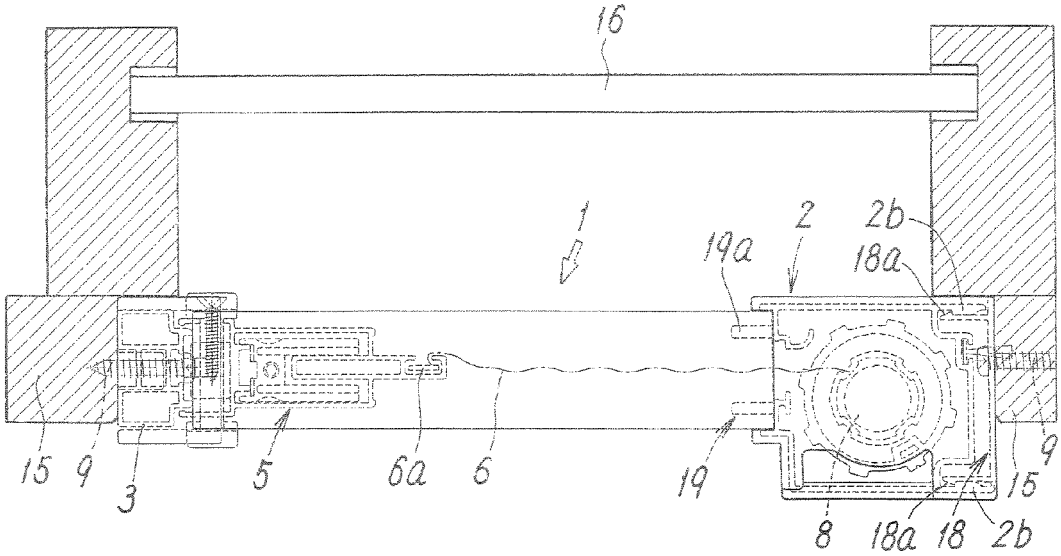
[FIG. 2] It is a plan view of the same.

As shown in FIG. 2, although the above lateral pull wire screen is disposed outside of a shoji (sliding paper screen) 16 provided in the building opening part, even if it is disposed inside or outside of room, the first longitudinal frame member 2 constituting the above winding box is not symmetrical shape in its front/back face side and, moreover, normally the prospective dimension becomes larger than the second longitudinal frame member 3 and the lateral frame member 4, so that it protrudes to an outside.

Thereupon, by constituting the first longitudinal frame member 2 and the movable frame 5 as a wire screen main body capable of being monolithically treated together with the net 6 attached between them, making it into substantially an upside/downside symmetrical shape, and reversing it in its upside and downside without reversing it in its front and back, there is constituted such that, even if there is a protrusion portion to the outside, the left/right convenience in the opening/closing of the net 6 can be altered.

As shown in FIG. 2, the longitudinal frame member 2 constituting the wire screen main body is fixed to a building opening part frame 15 through an attachment 18 (refer to FIG. 2, FIG. 4) for attaching, which is fixed to the building opening part frame 15 by screws 9. This fixation of the longitudinal frame member 2 is performed by detachably engaging protrusion parts 2*b* provided in insides of both-side walls of the first longitudinal frame member 2 with hook parts 18*a* in standing wall outer faces of the attachment 18. It is desirable that the attachment 18 forms a symmetrical shape in regard to a center face in a lengthwise direction passing its center.

Although there is made such that the wire screen frame 1 is fixed to the building opening part frame 15 by the screws 9, it is also possible to fix it by butting a back face of the wire screen frame 1 against a peripheral frame of the building opening part.

Figure 4:
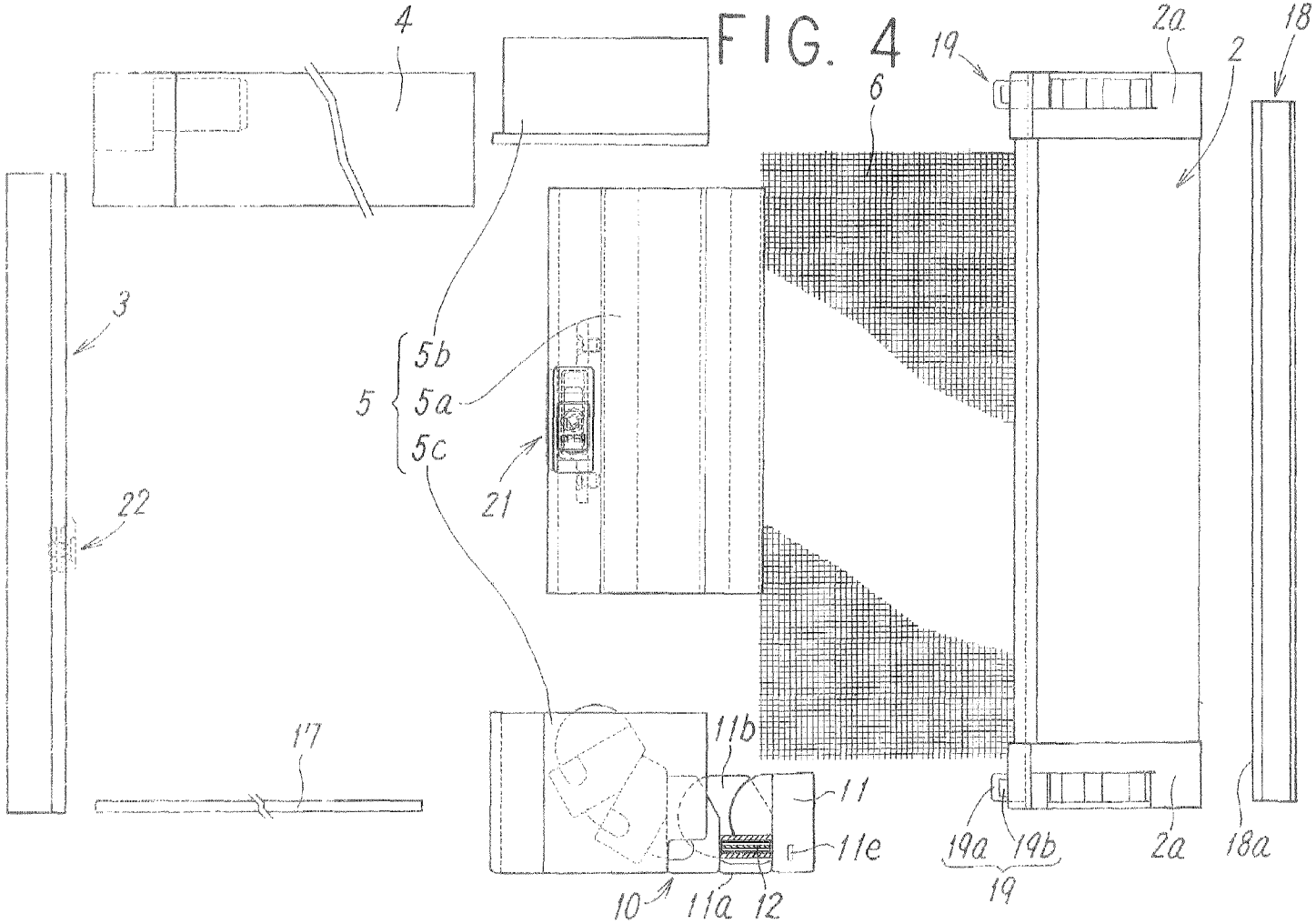
[FIG. 4] It is a front view showing a disassembled state of the lateral pull wire screen concerned with the invention.

As understood from FIG. 1, FIG. 4, the first longitudinal frame member 2 constituting the above winding box is substantially an upside/downside symmetrical shape. Further, although there is schematically shown in the drawing, in its inside there is accommodated the winding shaft 8, to which an end part of the net 6 is attached, while being rotatably supported. In the winding shaft 8, there is constituted such that a rotation biasing force by a twist of a coil spring accommodated in an inside of the winding shaft is made a drive source for a net winding by the winding shaft 8, and there is made such that the net 6 can be retained under a tension-provided state by causing a lock part piece 26 of a lock mechanism 21 provided in the movable frame 5 to engage with a lock receiver 22 provided in the longitudinal frame member 2 at a tension-provided time of the net 6.

Figure 5:
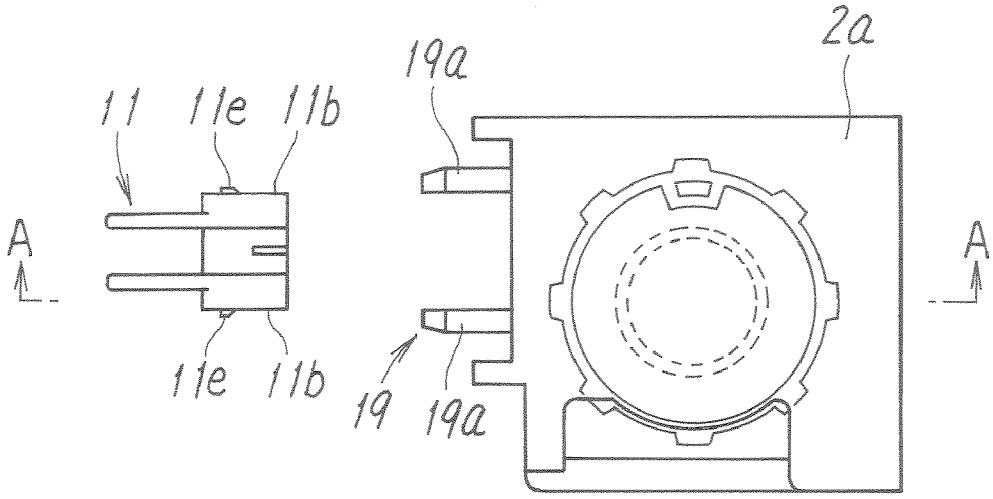
[FIG. 5] It is a disassembled plan view showing a structure of an attachment part attaching/detaching a net guide to/from a first longitudinal frame member.
Figure 6:
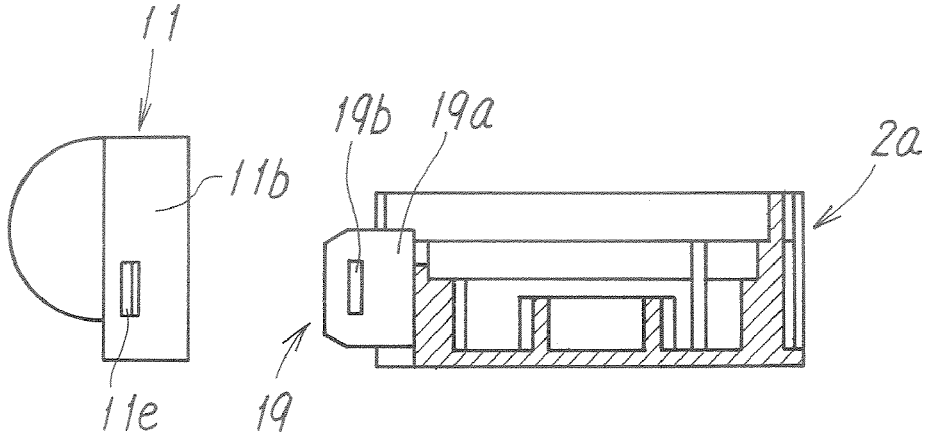
[FIG. 6] It is a view seen along an A-A arrow line in FIG. 5.

Further, as shown in FIG. 1-FIG. 4, to an upper end part and a lower end part of the first longitudinal frame member 2 constituting the winding box, there are attached respective caps 2*a* and, as shown in FIG. 5 and FIG. 6, in the cap 2*a* there is provided an attachment part 19 for selectively attaching a base end of the net guide 10.

Figure 7:
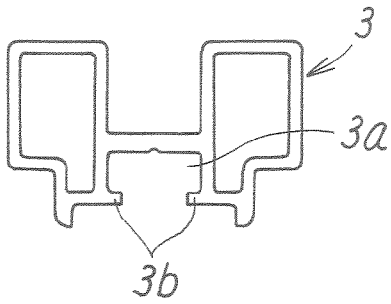
[FIG. 7] It is a sectional view of a second longitudinal frame member in FIG. 2.

The second longitudinal frame member 3 constituted as a reception frame is formed, as shown in FIG. 7, substantially as a symmetrical shape in its front/back side (left/right in the same drawing) in the wire screen frame 1, whose upper end is connected to the lateral frame member 4 as understood from FIG. 1 and FIG. 4, and in which there is provided the lock receiver 22 adjustable for a position in which the later-mentioned flock part piece 26 of the lock mechanism 21 engages. Therefor, there is made such that, on an occasion of the alteration of the left/right convenience in the opening/closing of the net 6, it is fixed to a side opposite to the building opening part by reversing it in its front and back without reversing it in is upside and downside. However, if it is made the upside/downside symmetrical shape and caused to have a constitution capable of being connected to the lateral frame member 4 by reversing it in its upside and downside, it is unnecessary to consider its upside/downside and front/back when attaching it to the building opening part and, if there is used later-mentioned upside/downside symmetrical one as the lock receiver 22 of the lock mechanism 21, there suffices if there is considered only its upside/downside position. By this, not only at a installation time of the lateral pull wire screen but also in a case changing the light/left convenience in the opening/closing of the net 6, it can be attached while being suitably reversed.

As understood from FIG. 7, the second longitudinal frame member 3 has, in an opposed face side to the movable frame 5, a groove 3*a* extending in the lengthwise direction, and one pair of protruded walls 3*b* protruding on the inside in an opening part of the groove 3*a*. About an attachment structure of the lock receiver 22 in regard to the second longitudinal frame member 3 having the groove 3*a*, there is mentioned later.

Figure 3:
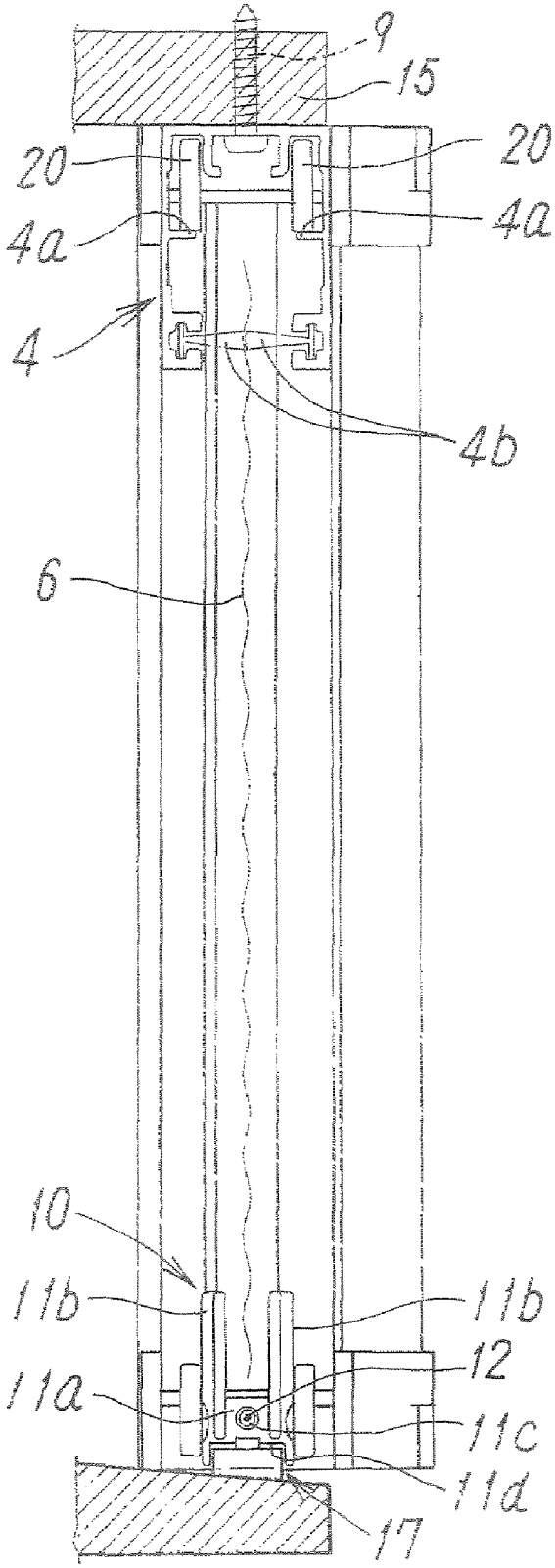
[FIG. 3] It is a side view of the same.

As shown in FIG. 3, the lateral frame member 4 has substantially the front/back symmetrical shape, is fixed to the building opening part frame 15 by the screw 9, is formed with a groove-like portion opening downward and guides end parts of the net 6 and the movable frame 5 by the groove-like portion. One pair of guide faces 4*a* for rotating rollers 20 constituting a guide mechanism provided in the movable frame 5 are provided in an inside of the lateral frame member 4.

Further, in its lower end mouth part, there is provided a brush-like slide contact member (mohair) 4*b* contacting with a surface of the net 6 to thereby prevent an insect's invasion.

The lateral frame member 4 may be made such that to its both ends there can be selectively connected the first and second longitudinal frame members 2, 3 and, in that case, it is unnecessary to make it the front/back symmetrical shape.

Figure 9:
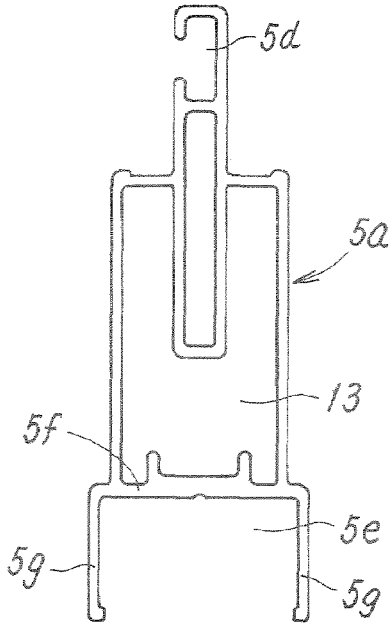
[FIG. 9] It is a sectional view of a movable frame main body.

As shown in FIG. 1, FIG. 2 and FIG. 4, the movable frame 5 has a movable frame main body 5*a* of the upside/downside symmetrical shape to which one end of the net 6 is attached, frame caps 5*b*, 5*c* attachable to and detachable from an upper part and a lower part of the movable frame main body 5*a*, and a lock mechanism 21 attached to an approximately center part of the movable frame main body 5*a* and having the lock part piece 26 (refer to FIG. 12) engaging with and disengaging from the lock receiver 22 of the second longitudinal frame member 3. The movable frame main body 5*a* has such a sectional shape as shown in FIG. 9, and concretely has an attachment piece insertion groove 5*d* in the lengthwise direction, into which a long plate-like attachment piece 6*a* (refer to FIG. 2) provided in one end of the net 6 is inserted and a mounting groove 5*e* which extends in the lengthwise direction, for mounting the lock mechanism 21. In its inside, there is formed an accommodation space 13 into which the net guide 10 explained below is introduced. The mounting groove 5*e* is formed by a bottom wall 5*f* extending in the lengthwise direction, and side walls 5*g* in both sides of the bottom wall 5*f*.

Furthers in the frame cap 5*b* in the upper part, there are possessed the rotatable rollers 20 (FIG. 3) as the guide mechanism, which are guided by the guide faces 4*a* of the lateral frame member 4, and, in the frame cap 5*c* in the lower part, there is provided a bend guide 14 (FIG. 1) for causing the net guide 10 explained below to go in and out to and from the accommodation space 13 in the movable frame main body 5*a* while being bent.

Since the movable frame main body 5*a* and the first longitudinal frame member 2 are mutually connected through the net 6, a wire screen main body constituted by them can be monolithically treated. Furthers since these members are the upside/downside symmetrical shapes except the detachable upper and lower frame caps 5*a*, 5*c* in the movable frame 5, the wire screen main body is formed also in the upside/downside symmetrical shape with exchanges of the upper and lower caps 5*b*, 5*c* of the movable frame.

As shown in FIG. 1-FIG. 6, the net guide 10 possesses many guide pieces 11 made of a synthetic resin, which are formed in an approximately U-shape by bottom parts 11*a* along the lower end of the net 6 and standing wall parts 11*b* which stand up along front/back both outer faces of the net, and the many guide pieces 11 are flexibly connected in a bend direction shown in FIG. 1 by inserting one wire 12 having a stretchability through connection holes 11*c* provided in centers of the bottom parts 11*a*. Additionally, as shown in FIG. 3, in a bottom part side of the guide piece 11, there is provided a groove 11*d* fitted to a long plane-like guide rail 17 refer to FIG. 3, FIG. 4) of a height of a degree not becoming a hindrance of walking, which has been attached to a floor face of the building opening part, and the net guide 10 is caused to suitably slide on the guide rail 17, thereby making a stable opening/closing of the net 6 possible.

Further, in the guide piece 11 at least in a most base end side of the guide pieces 11 under a connected state, engagement protrusions 11*e* are provided in its both-side outer faces. The engagement protrusions 11*e* are detachably engaged with the attachment part 19 having engagement part pieces 19*a* respectively, perpendicularly provided in the cap 2*a* in the first longitudinal frame member 2 and, by these, there is constituted such that a base end of the net guide 10 can be selectively connected to both ends of the first longitudinal frame member 2.

More concretely, as shown in FIG. 4-FIG. 6, the engagement part piece 19*a* is one in which its one pair protrude to a net guide 10 side from the cap 2*a*, and engagement grooves 19*b* with which the engagement protrusions 11*e* of the guide piece 11 engage are provided in the one pair of engagement part pieces 19*a* to which the guide piece 11 in the most base end side is inserted.

By the above-mentioned constitution, the net guide 10 and the guide piece 11 constituting the net guide 10 are ones in which its front/back (left/right in FIG. 3) has substantially the symmetrical shape.

Incidentally, in a case where a base end of the net guide 10 is fixed to the movable frame 5, it follows that, in the frame caps 5*b*, 5*c* of both ends in the movable frame 5, there is provided the attachment part 19 of the above-mentioned structure, which selectively attaches the net guide 10.

Next, there is explained about the lock mechanism 21 provided between the second longitudinal frame member 3 and the movable frame 5.

Figure 8:
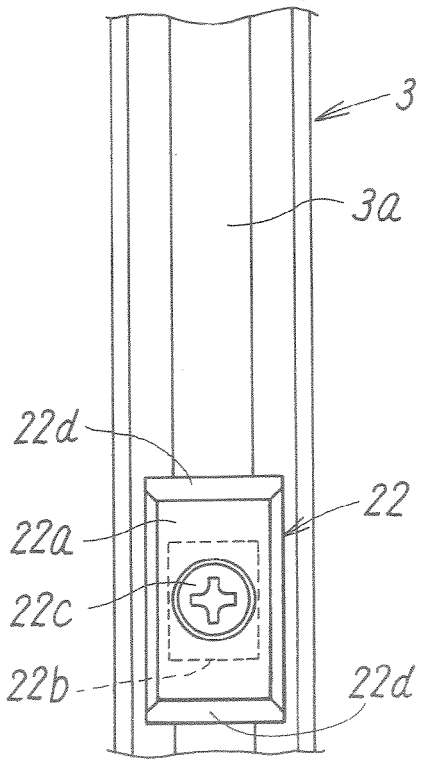
[FIG. 8] It is a partial side view showing a state in which a lock receiver is attached to the second longitudinal frame member.
Figure 12:
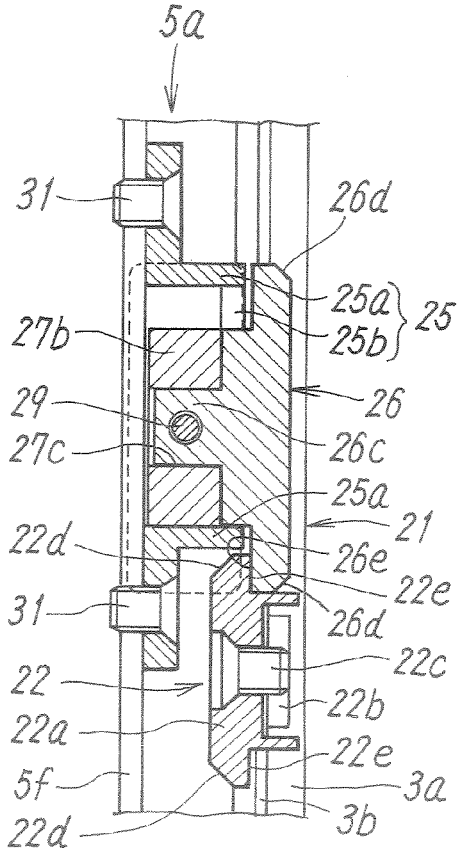
[FIG. 12] It is a partial side sectional view of the same.

As shown in FIG. 8 and FIG. 12, in the second longitudinal frame member 3, there is made such that the lock receiver 22 can be fixed so as to be adjustable for its position along the groove 3*a* formed in an opposed face side to the movable frame 5. The lock receiver 22 is larger in its lateral width than an opening width of the groove 3*a*. Further, a fixation fitment 22*b* in the groove 3*a*, to which a fixation screw 22*c* is mesh-inserted through a main body part 22*a* of the lock receiver 22, is larger in its lateral width than an opening width between the one pair of protruded walls 3*b* provided in the opening part of the groove 3*a*. Therefor, by the fixation screw 22*c*, the main body part 22*a* of the lock receiver 22 and the fixation fitment 22*b* are fastened tightly while nipping the one pair of protruded walls 3*b* and, therefore the lock receiver 22 can be fixed to an arbitrary position along the groove 3*a*. As shown in FIG. 12, the main body part 22*a* of the lock receiver 22 has, in its upper and lower parts, slant faces 22*d* guiding an engagement of the lock part piece 26, and in its back, an engagement part 22*e* with which the lock part piece 26 engages.

Figure 10:
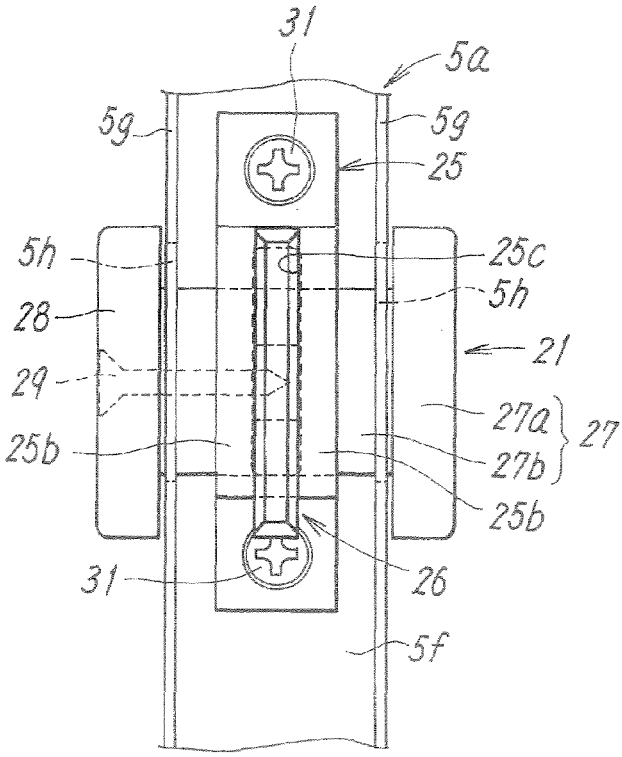
[FIG. 10] It is a partial enlarged side view showing a state in which a lock mechanism is attached to the frame main body.
Figure 11:
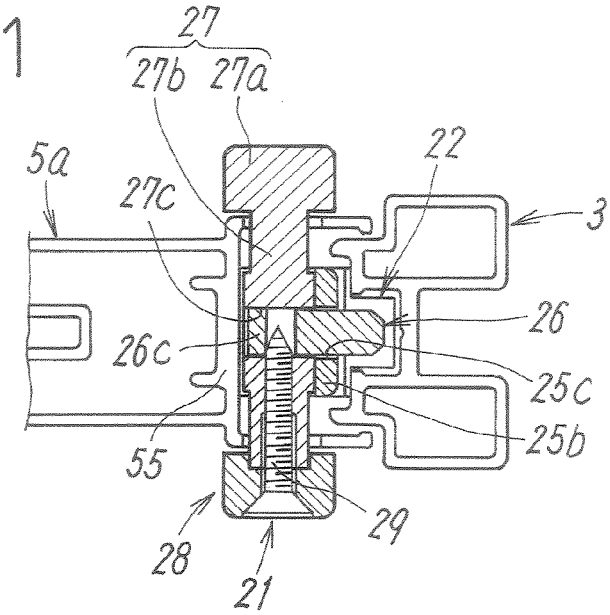
[FIG. 11] It is a partial plan sectional view showing a state in which the lock mechanism attached to the movable frame main body engages with the lock receiver attached to the second longitudinal frame member.

On the other hand, as shown in FIG. 10-FIG. 12, the lock mechanism 21 provided in the movable frame main body 5*a* has a lock cover 25 attached by screws 31 to the bottom wall 5*f* of the mounting groove 5*e* of the movable frame main body 5*a*, a lock part piece 26 which is disposed in the lock cover 25 so as to be slidable upward and downward, and which engages with and disengages from the lock receiver 22, and one pair of operation knobs 27, 28 in inner and outer sides connected to the lock part piece 26.

The operation knob 27 has a knob part 27*a*, and a shaft part 27*b* monolithically provided in the knob part 27*a*. The shaft part 27*b* is inserted into the mounting groove 5*e* through a long hole 5*h* provided in the side wall 5*g* of the movable frame main body 5*a* and, in a portion inserted into the mounting groove 5*e*, there is provided a fit hole 27*c* to which a fixation part 26*c* of the lock part piece 26 is fitted. By a fixation screw 29 mesh-inserted through the other operation knob 28, the operation knob 28 is fixed to a tip of the shaft part 27*b* in the operation knob 27 and, at the same time, the fixation part 26*c* of the lock part piece 26 can be fixed into the fit hole 27*c* of the shaft part 27*b*.

The operation knobs 27, 28, and the lock part piece 26, which are fixed in this manner, are mounted such that, for the engagement/disengagement in regard to the lock receiver 22 of the lock part piece, the shaft part 27*b* of the knob part 27*a* can move in upward and downward directions along the one pair of long holes 5*h* provided in the side wall 5*g* of the movable frame main body 5*a*.

The lock cover 25 has one pair of upper and lower position regulation parts 25*a* regulating an ascent position and a descent position of the lock part piece 26, and one pair of left and right connection walls 25*b* connecting the one pair of position regulation parts 25*a*. In a center part of the connection walls 25*b*, there is formed a guide groove 25*c* slidably guiding the lock part piece 26 in upward and downward directions.

Further, as shown in FIG. 12, the lock part piece 26 has, in its upper and lower parts, a slant face 26*d* opposing to the slant face 22*d* of the lock receiver 22, and in its back, an engagement part 26*e* engaging with the lock receiver 22, and forms the upside/downside symmetrical shape.

In the lock mechanism 21 having the above constitution, if the movable frame 5 is moved till a position butting against the second longitudinal frame member 3, since the lock part piece 26 climbs over the slant face 22*d* of the lock receiver 22 while resisting against a gravity, the engagement part 26*e* of the lock part piece 26 automatically engages with the engagement part 22*e* in the lock receiver 22 as shown in FIG. 12. On the other hand, if the lock part piece 26 is ascended by operating the operation knob 27 or 28, since the lock part piece 26 is lifted till it climbs over an uppermost end of the lock receiver 22, it is possible to release an engagement between the lock part piece 26 and the lock receiver 22.

In the lock mechanism 21 of the above embodiment, since in the side walls 5*g* of the movable frame main body 5*a*, there are provided one pair of long holes 5*h* in which the shaft part 27*b* of the knob part 27*a* moves in upward and downward directions, when installing this wire screen it is necessary to previously provide the long holes 5*h* in a suitable installation position of the lock mechanism 21. However, in a case where a position, in which the long hole 5*h* is open-provided, is unsuitable, it is necessary to open-provide again the long hole in a necessary position while leaving an unnecessary hole trail. In order to avoid such an issue, there suffices if there is adopted such a constitution that the long hole 5*h* for the shaft part 27*b* of the knob part 27*a* is made unnecessary, e.g., such a constitution that there is provided a knob part protruding to an outside along the side wall 5*g* from the inside of the mounting groove 5*e* of the movable frame main body 5*a*.

Further, in a case where the left/right convenience in the opening/closing of the wire screen installed already is altered, it there is no issue in its upside and downside positions, although the first longitudinal frame member 2 and the net 6 are reversed by detaching the movable frame 5 from the net 6, by fixing the movable frame 5 to the end part of the net 6 with its front and back being reversed while keeping its downside posture intact, it is possible to alter the left/right convenience in the net opening/closing by utilizing intact the long hole 57 initially open-provided. In this case, the fact that the movable frame having the lock mechanism 21 including the lock cover 25, the lock part piece 26 and the operation knobs 27, 28, and the second longitudinal frame member 3 having the lock receiver 22 are substantially, respectively the front/back symmetrical shapes, is effective for preventing especial hindrance from occurring by the alteration of the left/right convenience.

Additionally, since the lock mechanism 21 and the lock receiver 22 are made the upside/downside symmetrical shapes and thus made so as to be capable of being used even if their upsides and downsides are reversed, it is unnecessary to consider the upside and the downsides when installing them. Further, in cooperation with the fact that they are the symmetrical shapes also in their front and back sides, they are highly convenient for their attachments, and the like.

In the lateral pull wire screen having the above constitution, since the wire screen main body comprising the first longitudinal frame member 2 and the movable frame 5 in the wire screen frame 1 and the net 6 attached between them is substantially the upside/downside symmetrical shape, it is possible to alter the left/right convenience in the opening/closing of the net by reversing the wire screen main body in its upside and downside without revering it in its front and back. And, since one end of the net guide 10 can be always connected to the lower end of the first longitudinal frame member 2, it is possible to simply alter the left/right convenience in the opening/closing of the lateral pull wire screen having the net guide.

The invention claimed is:

1. A lateral pull wire screen comprising:

a wire screen frame that includes a first longitudinal frame member fixed to a building opening part in a longitudinal direction and a lateral frame member fixed to an upper part of the building opening part in a lateral direction;

a movable frame of which an upper end is guided by the lateral frame member and is disposed so as to be laterally pulled;

a net that is attached between the first longitudinal frame member and the movable frame and is openable and/or closeable by a lateral pull of the movable frame; and a net guide of which an end is detachably attached to the first longitudinal frame member, goes in and out to and from the inside of the movable frame while being bent in compliance with the opening and/or closing of the net caused by the lateral pull of the movable frame, and guides only a lower end of upper and lower ends of the net under a stretched state, wherein the first longitudinal frame member includes a pair of caps that is attached to upper and lower ends of the first longitudinal frame member, respectively, and is formed in a substantially symmetrical shape, each of the caps is provided with an attachment part that selectively attaches an end of the net guide to one of the caps, the end of the net guide is attached to the attachment part of the only cap, which is disposed at the lower end of the first longitudinal frame member, of the caps, the movable frame includes a frame main body that is formed in a substantially symmetrical shape, and upper and lower frame caps that are attached to upper and lower ends of the frame main body so as to be replaceable with each other, the upper frame cap is provided with a guide mechanism that is guided by the lateral frame member, the lower frame cap is provided with a bend guide that causes the net guide to go in and out to and from the inside of the frame main body while being bent, and left and/or right convenience in a net opening and/or closing can be altered by reversing the upside and downside of a wire screen main body that includes the first longitudinal frame member, the movable frame, and the net; attaching the upper and lower frame caps to the frame main body so that the upper and lower frame caps are replaced with each other; and attaching the end of the net guide to the attachment part of the cap, which is disposed at the lower end of the first longitudinal frame member, of the pair of caps of the first longitudinal frame member.

2. The lateral pull wire screen according to claim 1, wherein the wire screen frame includes a second longitudinal frame member that is fixed to the building opening part in the longitudinal direction so as to face the first longitudinal frame member, and the second longitudinal frame member is formed in a substantially symmetrical shape or symmetrical shape.

3. The lateral pull wire screen according to claim 2, wherein the second longitudinal frame member is formed in a substantially symmetrical shape.

4. The lateral pull wire screen according to claim 2, wherein the lateral frame member forms the shape of a groove that is opened downward, the upper end of the movable frame is guided by the guide mechanism of the upper frame cap at the groove-shaped portion, upper ends of the first and second longitudinal frame members are connected to both ends of the lateral frame member, and the lateral frame member is formed in a substantially symmetrical shape, or the first and second longitudinal frame members can be connected to the both ends of the lateral frame member so as to be replaced with each other.

5. The lateral pull wire screen according to claim 4, wherein the lateral frame member is formed in a substantially symmetrical shape.

6. The lateral pull wire screen according to claim 1, wherein the net guide includes first and second ends at both ends in a longitudinal direction, and is formed in a substantially symmetrical shape, the first end is detachably attached to the first longitudinal frame member, and the second end goes in and out to and from the inside of the movable frame while being bent in compliance with the opening and/or closing of the net caused by the lateral pull of the movable frame.

7. The lateral pull wire screen according to claim 6, wherein the net guide is constituted by connecting many guide pieces made of a synthetic resin, which are formed in approximately a U-shape by bottom parts along a lower end of the net and standing wall parts which stand up along an outer face of the net.

8. The lateral pull wire screen according to claim 7, wherein the attachment parts, which are provided at the pair of caps of the first longitudinal frame member, respectively, include a pair of engagement part pieces that is erected toward the net guide, and the first end of the net guide is detachably attached to the first longitudinal frame member by inserting the guide pieces, which are provided at the first end of the net guide, between the pair of engagement part pieces so as to make the guide pieces disengagably engage with the engagement part pieces.

9. The lateral pull wire screen according to claim 1, wherein the first longitudinal frame member is constituted as a winding box having a winding shaft which winds the net by a biasing force of a spring.

10. The lateral pull wire screen according to claim 2, wherein a lock receiver is fixed to the second longitudinal frame member so as to be adjustable for upside and downside positions, the movable frame main body is provided with a lock mechanism including a lock part piece that is provided so as to be slidable upward and/or downward and automatically engages with the lock receiver when being butted against the second longitudinal frame member, and operation knobs that are connected to the lock part piece so as to operate the lock part piece, and the lock part piece includes engagement parts, which engage with the lock receiver, at the upper and lower portions thereof.

11. The lateral pull wire screen according to claim 10, wherein the lock part piece is formed in a substantially symmetrical shape.

* * * * *